US007963196B2

(12) United States Patent
Musemeche et al.

(10) Patent No.: US 7,963,196 B2
(45) Date of Patent: Jun. 21, 2011

(54) TONG UNIT WITH CAGE PLATE HAVING REMOVABLE WINDOW SECTION

(75) Inventors: Clint Musemeche, Youngsville, LA (US); Clayton James Claxton, Lafayette, LA (US); Terrence James Musemeche, New Iberia, LA (US)

(73) Assignee: Mech-Tech Engineering, LLC, Broussard, LA (US)

( * ) Notice: Subject to any disclaimer, the term of this patent is extended or adjusted under 35 U.S.C. 154(b) by 6 days.

(21) Appl. No.: 12/435,450

(22) Filed: May 5, 2009

(65) Prior Publication Data

US 2009/0272231 A1 Nov. 5, 2009

Related U.S. Application Data

(60) Provisional application No. 61/050,360, filed on May 5, 2008.

(51) Int. Cl.

| | |
|---|---|
| ***B25B 13/48*** | (2006.01) |
| ***B23P 19/04*** | (2006.01) |
| ***E21B 19/16*** | (2006.01) |

(52) U.S. Cl. ..... 81/57.15

(58) Field of Classification Search ..... 81/57.15, 81/57.33

See application file for complete search history.

(56) References Cited

U.S. PATENT DOCUMENTS

| | | | | |
|---|---|---|---|---|
| 6,223,629 | B1 * | 5/2001 | Bangert | 81/57.15 |
| 2008/0202291 | A1 * | 8/2008 | Bouligny et al. | 81/57.16 |

* cited by examiner

*Primary Examiner* — David B Thomas

(74) *Attorney, Agent, or Firm* — Law Office of Jesse D. Lambert, LLC

(57) ABSTRACT

A tong unit having a ring gear, an upper cage plate, and a jaw assembly is disclosed. The cage plate has a removable window section, through which the jaw assembly may be inserted into and removed from the central opening in the ring gear. The jaw assembly may be attached to the removable window section, so that the window section and the jaw assembly can be lifted out and inserted together.

12 Claims, 3 Drawing Sheets

TONG UNIT WITH CAGE PLATE HAVING REMOVABLE WINDOW SECTION

CROSS REFERENCE TO RELATED APPLICATIONS

This regular patent application claims priority to U.S. provisional patent application Ser. No. 61/050,360, filed May 5, 2008, for all purposes.

BACKGROUND

1. Field of the Invention

This invention relates to apparatus used to screw together (or "make up") and unscrew (or "break out") threaded tubular connections joining sections (frequently called "joints") of tubulars, frequently (but not exclusively) used in the drilling of oil and gas wells. Such apparatus are commonly referred to as tong units.

2. Related Art

Tong units are used to screw together (or "make up") and unscrew (or "break out") threaded tubular connections joining sections (frequently called "joints") of tubulars. Such tubulars are frequently used in the drilling, servicing and completion of oil and gas wells, in the form of drill pipe, tubing, and other similar tubular goods. Such apparatus are commonly referred to as "tong units" or "power tongs," which use toothed dies carried by tong jaws, to transmit torque to the tubular connection. It is to be understood that the term tong unit, for purposes of this application, encompasses both the portion of the tong unit commonly referred to as the power tong portion of the tong unit (that is, the part that turns one side of the tubular connection) and the portion of the tong unit commonly referred to as the backup portion of the tong unit (that is, the part which holds the other side of the tubular connection).

In more detail, this invention relates to a tong unit which comprises an upper cage plate having a removable window section therein, as more particularly described herein.

DETAILED DESCRIPTION OF ONE EMBODIMENT OF THE INVENTION

By way of background, an exemplary tong unit will be described in sufficient detail to enable those having ordinary skill in the relevant art field to understand how the present invention is incorporated therein.

Tong Units Generally

Figure 1:
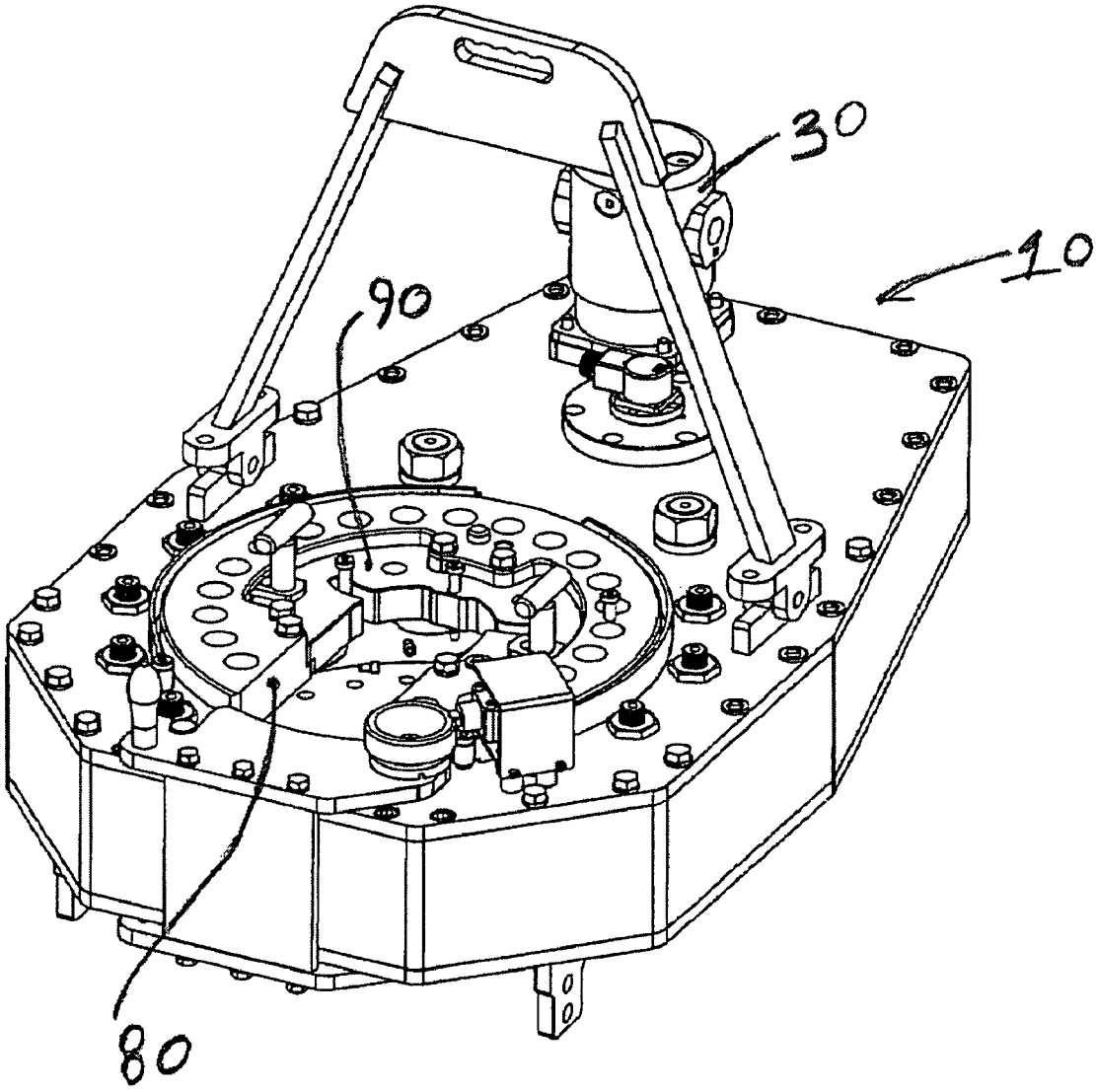
FIG. 1 is a perspective view of power tong portion of a tong unit.

With reference to the drawings, in FIG. 1, a tong unit 10 has a main body 11 which carries a gear system (not shown), which is driven by a motive source, typically a hydraulic motor 30. As is well known in the art, rotation of the motor turns the gears, which turn a ring gear within the tong body (hidden in FIG. 1, but shown in FIGS. 5 and 6). The rotary movement of the ring gear, and thereby torque, is transmitted from a ring gear 40 to a jaw assembly (see FIGS. 5 and 6, element 50), thence to dies 60 carried in the jaw assembly, and ultimately to a tubular connection, by the dies pressing against and/or biting into the metal of the connection. As is known in the art, the jaws are held within a central opening in ring gear 40 by cage plates 80 and 180 both above and below ring gear 40.

Tongs typically comprise upper and lower cage plates, with upper cage plate 80 shown on FIG. 1. Both upper and lower cage plates, element numbers 80 and 180 respectively, can be seen in the other drawings, especially FIGS. 5 and 6. The presently preferred embodiment is directed toward upper cage plate 80, which for simplicity will be referred to hereafter simply as cage plate 80. The cage plates, in general, position jaw assembly 50 relative to ring gear 40 within the tong unit.

Prior Art Cage Plate Arrangements

Prior art tong units used cage plates, and in particular an upper cage plate, that comprised a circle with a throat opening, as shown in FIG. 1 and the other figures. In order to install or remove a jaw assembly, it is necessary to either completely remove the cage plate (which is very time consuming due to the number of bolts holding it to the tong body), or the more common practice is to remove the pivot pins (on which the jaws pivot), physically reach inside the open throat of the tong, and slide the jaws out through the open throat. Several problems arise with this sequence: time is an issue, since it can be difficult to remove the jaws from this confined space; and there is a safety concern arising out of an operator having to place his hands within the throat of the power tong. In addition, due to the configuration of the prior art equipment, the size of tubular which a given tong can handle is limited by the size of the tong throat opening and the physical size of the jaws.

DESCRIPTION OF THE PRESENTLY PREFERRED EMBODIMENT(S)

The Upper Cage Plate with Removable Window Section of the Present Invention

Figures 2, 3, 4:
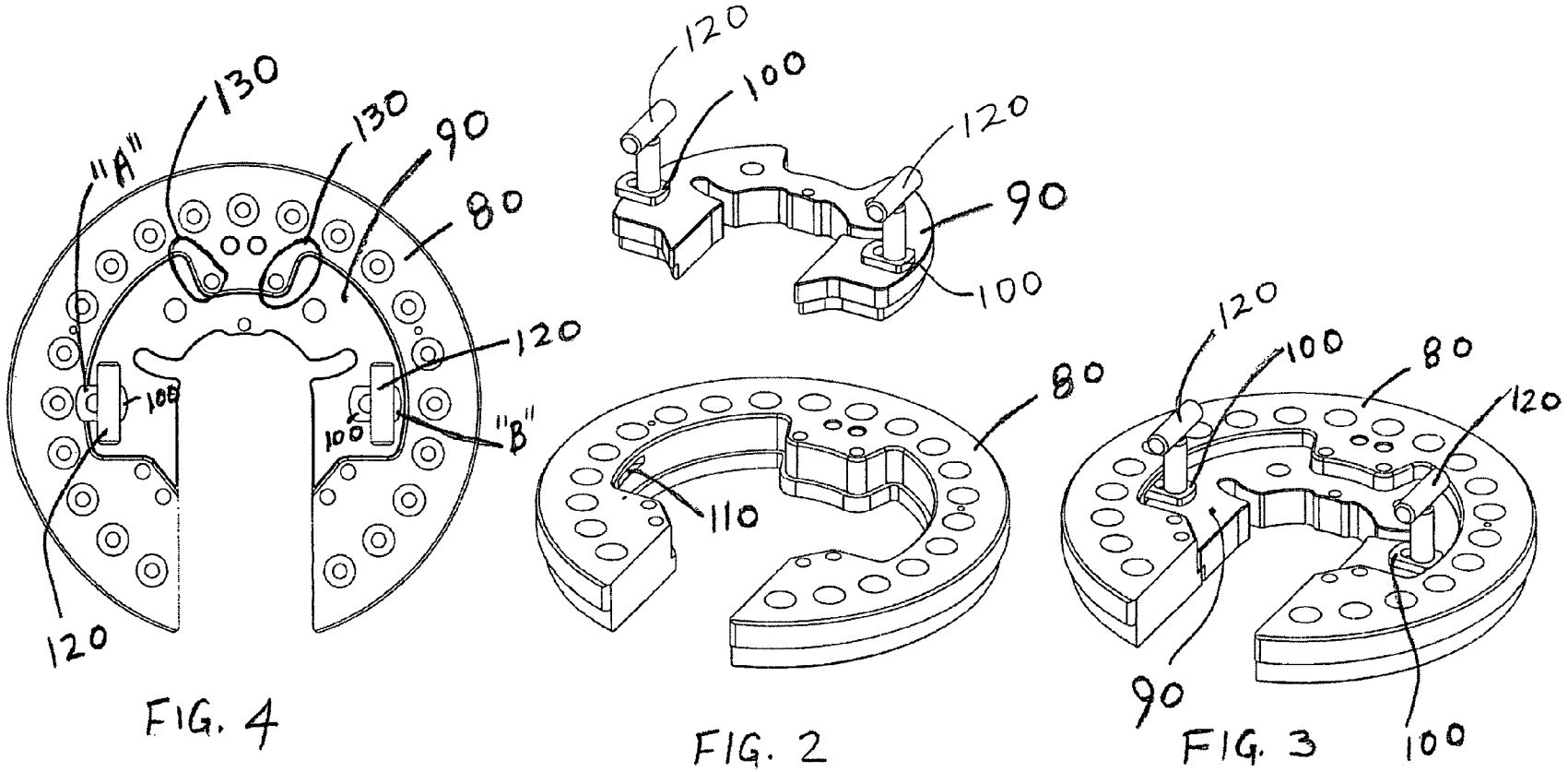
FIG. 2 is a perspective view of the cage plate, with the removable window section lifted out.
FIG. 3 is a perspective view of the cage plate, with the removable window section in place.
FIG. 4 is a top view of the cage plate, with the removable window section in place.

With reference to the drawings: the present invention comprises a tong unit having an upper cage plate 80 with a removable window section 90. FIG. 2 is a drawing of cage plate 80 with window section 90 lifted out of place, for clarity. FIG. 3 shows window section 90 in place within cage plate 80. In the preferred embodiment, a means for retaining window section 90 in place in cage plate 80 is provided. In the drawings, said means for retaining window section 90 comprises one or more lugs. When window section 90 is in place within cage plate 80, lugs 100 are slid into recesses 110 in cage plate 80, and then locked in this position by threaded T-handles 120. FIG. 4 shows this, with the lug indicated at "A" being in this extended position, while the lug indicated at "B" is retracted. FIGS. 2 and 3 also show this relationship. T-handles 120 also provide a convenient means to remove and replace window section 90.

Window section 90 can comprise any shape sufficiently sized to permit installation and removal of tong jaw assembly 50 within tong unit 10, more particularly within central opening of ring gear 40, when window section 90 is removed. In a presently preferred embodiment, window section 90 is shaped as shown in the drawings, yielding shoulders 130 providing torque resistance between window section 90 and the remainder of cage plate 80.

Figure 6:
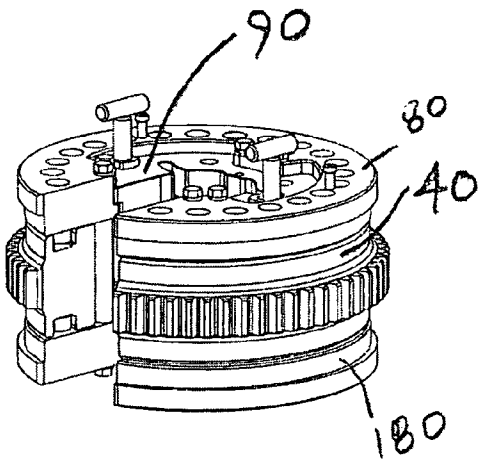
FIG. 6 is a perspective view of the removable window section and jaw assembly in place within the ring gear.
Figure 5:
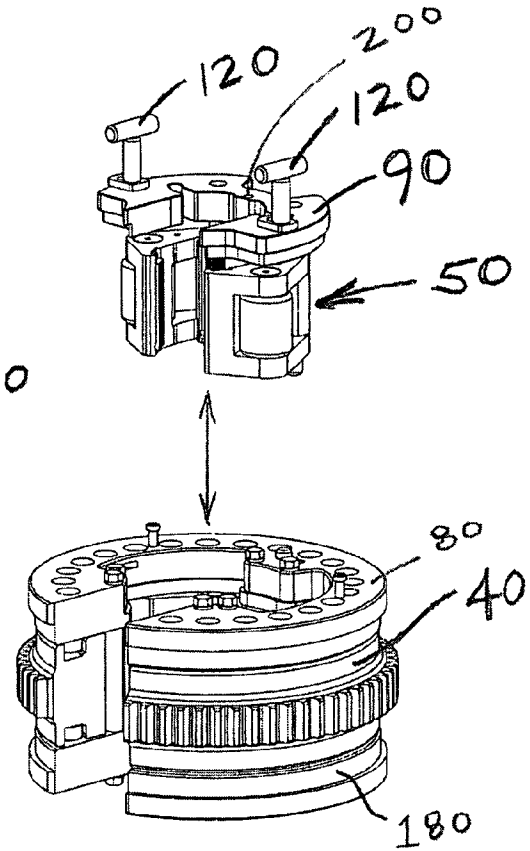
FIG. 5 is a is a perspective view of a cage plate atop a ring gear, with the removable window section and attached jaw assembly lifted out.
Figure 7:
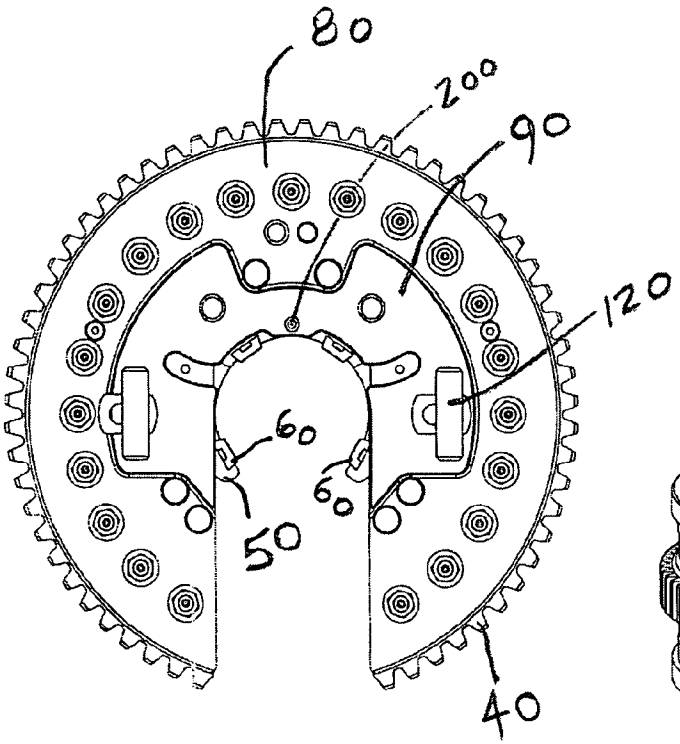
FIG. 7 is a top view of the cage plate, with the removable window section and jaw assembly in place within the ring gear.

As can be seen in FIG. 5, window section 90 fits atop jaw assembly 50. While it is understood that the present invention can be used with various types of jaw assemblies (e.g., two-jaw pivoting jaw assembly, two-jaw sliding jaw assembly, or some other arrangement), this invention is advantageously used in combination with a three-jaw assembly, as seen in FIGS. 5 and 7. FIGS. 6 and 7 show the jaw assembly and insert section in place within ring gear 40. This type of jaw assembly comprises a rear jaw (which is stationary with respect to cage plate 80) and two side jaws, one on either side of the rear jaw, which are rotatably attached with respect to cage plate 80.

Preferably, jaw assembly 50 is connected to window section 90 by one or more fasteners, such as bolts 200. In this arrangement, the entire assembly—that is, window section 90 and jaw assembly 50—can be lifted out of tong 10 by loosening T-handles 120 sufficiently to retract lugs 100, then re-tightening T-handles (with the lugs retracted, thereby freeing insert section from the cage plate) as desired, then lifting T-handles, which will remove window section 90 and the attached jaw assembly 50, as can be seen in FIG. 5.

It is appreciated that different jaw assemblies, for different size jaws, can be easily changed out.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example, dimensions of the various components may be varied to suit particular applications. The size and shape of the window in the upper cage plate may be varied. Different materials may be used for different components. Different means of retaining the window section within the cage plate may be used.

Therefore, the scope of the invention is to be determined not by the illustrative examples set forth above, but by the appended claims and their legal equivalents.

We claim:

1. A tong unit, comprising:

a ring gear having a central opening; and a cage plate disposed above said ring gear, said cage plate comprising a removable window section of sufficient size that a jaw assembly may be inserted into and removed from said central opening of said ring gear, through an opening in said cage plate formed by removal of said window section, further comprising a jaw assembly attached to said window section of said cage plate and disposed within said central opening of said ring gear when said window section is in place in said cage plate, and wherein said jaw assembly comprises a rear jaw stationary with respect to said cage plate, and two side jaws, one on each side of said rear jaw, which are rotatably connected with respect to said cage plate.

2. A tong unit, comprising:

a ring gear having a central opening; and a cage plate disposed above said ring gear, said cage plate comprising a removable window section of sufficient size that a jaw assembly may be inserted into and removed from said central opening of said ring gear, through an opening in said cage plate formed by removal of said window section, further comprising a jaw assembly attached to said window section of said cage plate and disposed within said central opening of said ring gear when said window section is in place in said cage plate, and further comprising a means for retaining said window section to the remainder of said cage plate, wherein said means for retaining comprises one or more slidable lugs.

3. A tong unit, comprising:

a ring gear having a central opening; and a cage plate disposed above said ring gear, said cage plate comprising a removable window section of sufficient size that a jaw assembly may be inserted into and removed from said central opening of said ring gear, through an opening in said cage plate formed by removal of said window section, wherein said removable window section comprises shoulders which bear against mating shoulders in the remaining part of said cage plate, thereby preventing relative rotation between said removable window section and the remaining part of said cage plate.

4. The tong unit of claim 3, further comprising a jaw assembly attached to said removable window section of said cage plate and disposed within said central opening of said ring gear when said removable window section is in place in said cage plate.

5. The tong unit of claim 4, wherein said jaw assembly comprises a rear jaw stationary with respect to said cage plate, and two side jaws, one on each side of said rear jaw, which are rotatably connected with respect to said cage plate.

6. The tong unit of claim 4, further comprising one or more handles attached to said removable window section of said cage plate, for removing said removable window section and jaw assembly from said central opening of said ring gear, and for replacing said removable window section and jaw assembly therein.

7. The tong unit of claim 3, further comprising one or more handles attached to said removable window section of said cage plate, for removing said removable window section from the remaining part of said cage plate, and for replacing said removable window section therein.

8. The tong unit of claim 3, further comprising a means for retaining said removable window section within the remaining part of said cage plate.

9. The tong unit of claim 8, wherein said means for retaining comprises one or more slidable lugs.

10. The tong unit of claim 9, further comprising a jaw assembly attached to said removable window section of said cage plate and disposed within said central opening of said ring gear when said removable window section is in place in said cage plate.

11. The tong unit of claim 10, wherein said jaw assembly comprises a rear jaw stationary with respect to said cage plate, and two side jaws, one on each side of said rear jaw, which are rotatably connected with respect to said cage plate.

12. The tong unit of claim 11, further comprising one or more handles attached to said removable window section of said cage plate, for removing said removable window section and jaw assembly from said central opening of said ring gear, and for replacing said removable window section and jaw assembly therein.

* * * * *